US005389490A

United States Patent [19]

Tomita et al.

[11] Patent Number: 5,389,490

[45] Date of Patent: Feb. 14, 1995

[54] CAPSULE TONER AND PROCESS FOR PRODUCING THE SAME

[75] Inventors: Kazufumi Tomita; Izuru Matsui; Koichi Takashima, all of Minami Ashigara, Japan

[73] Assignee: Fuji Xerox Co., Ltd., Tokyo, Japan

[21] Appl. No.: 94,348

[22] Filed: Jul. 21, 1993

[30] Foreign Application Priority Data

Jul. 24, 1992 [JP] Japan ..... 4-198523

[51] Int. Cl.[6] ..... G03G 9/093

[52] U.S. Cl. ..... 430/138; 430/109

[58] Field of Search ..... 430/138, 98, 110, 109

[56] References Cited

U.S. PATENT DOCUMENTS 4,656,111 4/1987 Wakamiya et al. ..... 430/109
4,708,924 11/1987 Nagai et al. ..... 430/138

FOREIGN PATENT DOCUMENTS 57-179860 11/1982 Japan .
58-66946 4/1983 Japan .
58-145964 8/1983 Japan .
59-148066 8/1984 Japan .
59-162562 9/1984 Japan .
60-222866 11/1985 Japan .
63-163373 7/1988 Japan .

OTHER PUBLICATIONS

Polyurethane Jushi Handbook (Polyurethane Resin Handbook), pp. 70–98.
Textbook For Third Lecture For Introduction To Vehicles, pp. 57–66.

*Primary Examiner*—John Goodrow
*Attorney, Agent, or Firm*—Oliff & Berridge

[57] ABSTRACT

A capsule toner and a process for producing the same, the capsule toner comprising a core material containing a fixing component, an outer shell covering the core material, and a chargeable substance adhered on the surface of the outer shell, the outer shell containing a polyurea resin and/or a polyurethane resin each obtained from an aliphatic polyisocyanate and an aromatic polyisocyanate. The capsule toner exhibits satisfactory charging properties while surely holding the fixing component inside to provide high quality images with excellent fixing properties.

20 Claims, No Drawings

CAPSULE TONER AND PROCESS FOR PRODUCING THE SAME

FIELD OF THE INVENTION

This invention relates to a capsule toner for developing an electrostatic latent image, a magnetic latent image, etc. and a process for producing the same.

BACKGROUND OF THE INVENTION

Known fixing methods of an electrophotographically formed toner image include heat fixing and pressure fixing. Heat fixing requires a rise time for a fixing means to be heated up to a prescribed temperature after turning on the power and afterward energy for maintaining the fixing means at that temperature. Pressure fixing, on the other hand, requires neither a rise time nor heating energy. However, fixing strength obtained by pressure fixing is not sufficient so that high pressure should be applied for providing a toner image resistant to rubbing.

Capsule toners comprising a core material containing a fixing component, and a hard outer shell, which completely covers the core material, have been developed for solving the above-mentioned fixing problems. The outer shell of a capsule toner is destroyed on pressure application, and the fixing component runs off and is fixed on an image-receiving medium, such as paper and an OHP sheet.

Capsule toners may contain magnetic particles for imparting magnetic characteristics or colorant particles for coloring. However, if a large amount of magnetic particles or colorant particles is incorporated into the capsule core material, the core material will have a so increased viscosity, and the fixing component fails to run off on pressure application, only resulting in poor fixing.

In order to improve fixing properties of capsule toners, it is necessary that a major proportion of the colorant particles or magnetic particles be present in the shell. However, if these particles are exposed on the surface of the shell, the resistivity of that part decreases to reduce insulating properties of the capsule surface, which may cause leakage of electric charge, resulting in a reduction in charge quantity. Where the colorant particles or magnetic particles are hydrophilic, the charging properties become largely dependent on environmental conditions. Therefore, it is important that the colorant particles or magnetic particles should not be exposed on the shell surface.

If the fixing component oozes out of capsules during preparation or storage, the toner undergoes agglomeration or considerable reduction in fixing properties. Therefore, the outer shell of capsule toners must block penetration of the fixing component. From this viewpoint, however, the conventional capsule toners are not always satisfactory.

For example, JP-A-57-179860 (the term "JP-A" as used herein means an "unexamined published Japanese patent application") discloses a capsule toner whose outer shell comprises polyurethane or polyurea prepared by the reaction of an isocyanate, water, and an amine or glycol component, and JP-A-60-222866 discloses a capsule toner whose outer shell comprises polyurethane or polyurea prepared by using one bifunctional isocyanate and at least one tri- or polyfunctional isocyanate. In cases where the amount of magnetic particles to be incorporated is increased or where the shell thickness is decreased for capsule size reduction, the colorant particles or magnetic particles are ought to have an increased concentration in the shell and be exposed on the shell surface. As a result, the quantity of charge is reduced, environment dependence of charging properties is increased, or the colorant particles or magnetic particles pierce the shell, through which the fixing component, particularly a low-molecular-weight component would run out.

SUMMARY OF THE INVENTION

An object of the present invention is to provide a capsule toner which retains satisfactory charging properties and surely retains a fixing component inside the shell and therefore exhibits excellent fixing properties to provide a toner image with excellent quality.

Another object of the present invention is to provide a process for producing the above-mentioned capsule toner.

Other objects and effects of the present invention will be apparent from the following description.

The present invention relates to a capsule toner comprising a core material containing a fixing component, an outer shell covering the core material, and a chargeable substance adhered on the surface of the shell, the outer shell containing a polyurea resin and/or a polyurethane resin each obtained from at least an aliphatic polyisocyanate and an aromatic polyisocyanate.

The above-mentioned capsule toner includes an embodiment in which the capsule toner comprises a core material containing a fixing component, an outer shell covering the core material, a chargeable substance chemically bonded to the surface of the outer shell, and colorant particles and/or magnetic particles contained in the shell, the outer shell containing a polyurea resin and/or a polyurethane resin each obtained from at least an aliphatic polyisocyanate and an aromatic polyisocyanate.

The present invention also relates to a process for producing the above capsule toner comprising (a) a step of dispersing at least colorant particles and/or magnetic particles, a fixing component, and an oily component containing an aliphatic polyisocyanate and an aromatic polyisocyanate in a solvent, (b) a step of polymerizing the dispersed particles to form an outer shell containing a polyurea resin and/or a polyurethane resin, and (c) a step of adhering a chargeable substance on the surface of the outer shell.

The present invention also relates to a capsule toner comprising a core material containing a fixing component and an outer shell covering the core material, the outer shell containing a polyurea resin and/or a polyurethane resin each obtained from at least an aliphatic polyisocyanate and an aromatic polyisocyanate.

DETAILED DESCRIPTION OF THE INVENTION

If a capsule shell is formed by using an aliphatic polyisocyanate having a low reaction rate as a sole isocyanate component, colorant particles or magnetic particles are easily incorporated into the shell and pierce the shell, resulting in a failure of surely holding a fixing component inside the shell. If, on the other hand, a capsule shell is formed by using an aromatic polyisocyanate having a high reaction rate as a sole isocyanate component, colorant particles or magnetic particles are apt to be incorporated into the core material but not into the shell. It follows that the viscosity of the core material considerably increases, failing to let the fixing component run off even on pressure application, resulting in poor fixing.

The above problems are now solved by the present invention. According to the present invention, it is considered that an aromatic polyisocyanate having a high reaction rate first undergoes reaction to form an outermost layer, and then a slow-reacting aliphatic polyisocyanate forms an inner layer while taking in colorant particles or magnetic particles. Thus, the colorant particles or magnetic particles are never exposed on the shell surface, and a fixing component can be surely confined within the outer shell. Further, charging properties of the capsule toner can be improved by adhering a chargeable substance to the shell surface to thereby provide a capsule toner capable of providing images with improved quality and improved fixing strength.

The terminology "aliphatic polyisocyanates" as used herein means polyisocyanates whose isocyanate groups are not bonded directly to an aromatic ring. Specific examples of the aliphatic polyisocyanates include trimethylene diisocyanate, hexamethylene diisocyanate, 2,2,4-trimethylhexane diisocyanate, cyclohexane-1,2-diisocyanate, 1-methylcyclohexane-2,4-diisocyanate, isophorone diisocyanate, cyclohexylmethane-4,4-diisocyanate, lysine diisocyanate, xylylene diisocyanate, m-phenylenebis(isopropylisocyanate), and dicyclohexylmethane diisocyanate. Among them preferred are xylylene diisocyanate, hexamethylene diisocyanate, and dicyclohexylmethane diisocyanate. These aliphatic isocyanates may be used either individually or in combination thereof.

The terminology "aromatic polyisocyanates" as used herein means polyisocyanates whose isocyanategroups are bonded directly to an aromatic ring. Specific examples of the aromatic polyisocyanates include phenylene diisocyanate, tolylene diisocyanate, naphthalene-1,4-diisocyanate, naphthalene-1,5-diisocyanate, tolidine diisocyanate, diphenylmethane diisocyanate, 3,3'-dimethyldiphenylmethane-4,4'-diisocyanate, 3,3'-dimethoxydiphenylmethane-4,4'-diisocyanate, diphenyl ether-4,4'-diisocyanate, 4,4'-dimethyldiphenylmethane-2,2',5,5'-tetraisocyanate, and triphenylmethane-4,4',4''-triisocyanate. Preferred of them are diphenylmethane diisocyanate, triphenylmethane triisocyanate, and tolylene diisocyanate. These aromatic polyisocyanates may be used either individually or in combination thereof.

The aliphatic isocyanate is generally used in an amount of from 2 to 95% by weight, preferably from 5 to 85% by weight, and more preferably from 55 to 85% by weight, based on the total isocyanate components.

Reactants which react with the above-mentioned isocyanate component to produce a polyurethane resin or a polyurea resin include polyamines, polyols, and water. Specific examples of the polyamines include ethylenediamine, hexamethylenediamine, diethylenetriamine, iminopropylamine, triethylenetetramine, trimethylenediamine, tetramethylenediamine, pentamethylenediamine, p-phenylenediamine, m-phenylenediamine, 2-hydroxytrimethylenediamine, diethylaminopropylamine, tetraethylenepentamine, xylylenediamine, diphenylmethanediamine, piperazine, 2,5-dimethylpiperazine, and a polyoxydialkyleneamine. Specific examples of the polyols include diols, such as catechol, resorcinol, hydroquinone, dihydroxymethylbenzene, naphthalenediol, ethylene glycol, 1,4-butanediol, propylene glycol, butylene glycol, and hexamethylene glycol; and triols, such as glycerin, trimethylolpropane, trimethylolethane, and 1,2,6-hexanetriol. Preferred of these reactants are diethylenetriamine, triethylenetetramine, and tetraethylenepentamine.

The core material for capsule toners for pressure fixing mainly comprises pressure-fixable components, and that for capsule toners for heat fixing mainly comprises heat-fixable components. The kinds and ratios of these components and the thickness of the shell can be appropriately decided according to the end use.

For pressure fixable capsule toners, examples of the core material include (1) a mixture mainly comprising a binder resin, a high-boiling solvent capable of dissolving the binder resin, and a colorant, (2) a mixture mainly comprising a binder resin, an oligomer capable of dissolving the binder resin, and a colorant, and (3) a mixture mainly comprising a soft solid substance and a colorant. Among these, the embodiments (1) and (2) are preferred in the present invention. If desired, the colorant may be replaced with a magnetic powder, and additives, such as silicone oil, may be added for the purpose of improving fixing properties. A high-boiling solvent incapable of dissolving a binder resin may be used in combination.

The binder resins which can be used in the core material are conventional. Examples of the binder resins include acrylic ester polymers, e.g., polymethyl acrylate, polyethyl acrylate, polybutyl acrylate, poly-2-ethylhexyl acrylate, and polylauryl acrylate; methacrylic ester polymers, e.g., polymethyl methacrylate, polybutyl methacrylate, polyhexyl methacrylate, poly-2-ethylhexyl methacrylate, and polylauryl methacrylate; acrylic estermethacrylic ester copolymers; styrene monomer-(meth)acrylic ester copolymers; ethylenic polymers or copolymers, e.g., polyvinyl acetate, polyvinyl propionate, polyvinyl butyrate, polyethylene, and polypropylene; styrene copolymers, e.g., a styrene-maleic acid copolymer; polyvinyl ether, polyvinyl ketone, polyester, polyamide, polyurethane, rubbers, epoxy resins, polyvinyl butyral, rosin, modified rosin, terpene resins, and phenolic resins. These binder resins may be used either individually or in combination thereof. The binder resin may be prepared in situ by polymerization of the corresponding monomer(s) after encapsulation.

Preferred examples of the binder resin include homopolymers obtained from acrylic ester monomers or methacrylic ester monomers and copolymers obtained from these monomers and styrene monomers.

The high-boiling solvents capable of dissolving the binder resin are so-called oils having a boiling point of 140° C. or higher, and preferably 160° C. or higher. The high-boiling solvent to be used may be chosen from, for example, those described in *Modern Plastics Encyclopedia,* chapter of "Plasticizer" (1975–76), or those disclosed in JP-A-58-145964 and JP-A-63-163373 as core substances for pressure-fixable capsule toners. Specific examples of suitable high-boiling solvents include phthalic esters (e.g., diethyl phthalate and dibutyl phthalate), aliphatic dicarboxylic acid esters (e.g., diethyl malonate and dimethyl oxalate), phosphoric esters (e.g., tricresyl phosphate and trixylyl phosphate), citric esters (e.g., o-acetyltriethyl citrate), benzoic esters (e.g., butyl benzoate and hexyl benzoate), fatty acid esters (e.g., hexadecyl myristate, dioctyl adipate, linseed oil, castor oil, and perilla oil), alkylnaphthalenes (e.g., methylnaphthalene, dimethylnaphthalene, monoisopropylnaphthalene, and diisopropylnaphthalene), alkyldiphenyl ethers (e.g., o-, m- or p-methyldiphenyl ether), higher fatty acid amides or aromatic sulfonic acid amides (e.g., N,N-dimethyllauramide and N-butylbenzenesulfonamide), trimellitic esters (e.g., trioctyl trimellitate), diarylalkanes (e.g., diarylmethanes, e.g., dimethylphenylphenylmethane; and diarylethanes, e.g., 1-phenyl-1-methylphenylethane, 1-dimethylphenyl-1-phenylmethane, and 1-ethylphenyl-1-phenylethane), saturated aliphatic hydrocarbons, unsaturated aliphatic hydrocarbons, and chlorinated paraffins.

The soft solid substances which can be used as a core material for pressure-fixable capsule toners are not particularly limited as far as the substance has softness at room temperature and exhibits fixing properties. In particular, a polymer having a glass transition temperature between −60° and 5° C. or a mixture of such a polymer and other polymers are preferred.

The colorants which can be used in the core material include inorganic pigments, such as carbon black, red oxide, Prussian blue, and titanium oxide; azo pigments, such as Fast Yellow, Disazo Yellow, Pyrazolone Red, Chelate Red, Brilliant Carmine, and Para Brown; phthalocyanine pigments, such as copper phthalocyanine and metal-free phthalocyanine; and condensed polycyclic pigments, such as Flavanthrone Yellow, Dibromoanthrone Orange, Perylene Red, Quinacridone Red, and Dioxazine Violet.

The whole or a part of a black colorant may be replaced with magnetic powder to obtain a magnetic one-component toner. Examples of the magnetic powder include magnetite, ferrite, and single metals, e.g., cobalt, iron, and nickel, or alloys thereof.

The amount of the colorant is generally from 10 to 75% by weight, preferably from 35 to 65% by weight, based on the total amount of the toner in the case where the colorant is magnetic powder. It is generally from 0.1 to 20% by weight, preferably from 0.5 to 10% by weight, based on the total amount of the toner in the case where the colorant is a non-magnetic pigment.

For accomplishing pressure fixing, it is necessary to decrease the viscosity of the core material so that the fixing component may run out of the capsule on pressure application. To this effect, at least 60% by weight, and preferably 90% by weight or more, of colorant particles and/or magnetic particles should be desirably distributed in the capsule shell.

In order to facilitate incorporation of colorant particles or magnetic particles into the shell, the particles may previously be surface-treated with a coupling agent, such as a silane coupling agent or a titanate coupling agent, or an oil-soluble surface active agent, or be coated with an acrylic resin, a styrene resin or an epoxy resin.

The capsule toner of the present invention are preferably produced by an interfacial polymerization technique. For example, a polymeric core component amongst core components can be incorporated into a capsule by charging a separately prepared polymer together with other core components, a low-boiling solvent, and shell-forming components, followed by interfacial polymerization to form an outer shell. It is also possible that monomer(s) providing the polymeric component are charged and then, after interfacial polymerization to form an outer shell, polymerized in situ to form a core (as described in JP-A-57-179860, JP-A-58-66946, JP-A-59-148066, and JP-A-59-162562). The low-boiling solvent which can be used in interfacial polymerization includes those having a boiling point of not more than 100° C. Examples of the low-boiling solvents include n-pentane, n-hexane, methylene chloride, ethylene chloride, carbon disulfide, acetone, methyl acetate, ethyl acetate, chloroform, methyl alcohol, ethyl alcohol, tetrahydrofuran, carbon tetrachloride, methyl ethyl ketone, benzene, ethyl ether, and petroleum ether. These solvents may be used either individually or in combination thereof.

The particles of the capsule toner of the present invention preferably have an average particle size of from 1 to 30 μm, and more preferably from 2 to 18 μm.

The chargeable substance which is adhered on the shell surface is not particularly limited. Examples thereof include those positively chargeable, such as polymerizable monomers having a functional group, such as an amino group, an imidazole group, a pyridine group, a piperazine group, etc.; those negatively chargeable, such as polymers comprising a polymerizable monomer having a functional group, such as a halogen atom, a nitro group, a cyano group, a sulfo group, a carboxyl group, a carboxylic ester group, a phospho group, etc.; and fine particles with the above-mentioned functional group on the surface thereof.

The chargeable substance is adhered on the surface of the capsule shell by known techniques, such as graft polymerization, phase separation, dry blending, wet blending, and the like. Among others, graft polymerization is recommended from the standpoint of durability and uniformity.

The amount of the chargeable substance is generally from 0.05 to 10% by weight, preferably from 0.1 to 5% by weight, based on the total amount of the toner.

For the purpose of imparting fluidity to capsule toners, fine particles of metal oxides (e.g., silicon oxide and aluminum oxide) metal salts, ceramics, resin, or carbon black may be adhered to the shell surface by, for example, dry blending with a dried capsule toner by means of a twin-cylinder mixer or a Henschel mixer or by adding in the form of an aqueous slurry in water, an alcohol, etc. to a capsule toner slurry followed by drying.

The capsule toner of the present invention is used as a one-component developer or a two-component developer. In the latter case, the toner is used as a mixture with a carrier. Known carriers, such as a ferrite powder, an iron oxide powder, a nickel powder, etc. which may be coated with a resin, may be used.

The present invention will now be illustrated in greater detail with reference to Examples, but it should be understood that the present invention is not construed as being limited thereto. All the parts and percents are by weight unless otherwise indicated.

EXAMPLE 1

PREPARATION OF CAPSULE PARTICLES

In a mixed solvent of 60 g of diethyl phthalate and 60 g of ethyl acetate were dissolved 30 g of polyisobutyl methacrylate (weight average molecular weight (Mw): $16\times10^4$) and 40 g of a styrene-n-butyl methacrylate copolymer (Mw: $6\times10^4$), and 200 g of magnetic powder (EPT-1000 produced by Toda Kogyo Co., Ltd.) was added thereto, followed by dispersing in a ball mill for 16 hours.

To 200 g of the dispersion were added 25 g of dicyclohexylmethane diisocyanate (Desmodur W produced by Sumitomo Bayer Urethane Co., Ltd.) as an aliphatic isocyanate, 5 g of diphenylmethane diisocyanate (Isonate 143L produced by Mitsubishi Chemical Dow Corp.) as an aromatic isocyanate, and 24 g of ethyl acetate, followed by thoroughly mixing. The resulting liquid was designated Composition A.

Separately, 10 g of hydroxypropylmethyl cellulose (Metholose 60 SH 50 produced by Shin-Etsu Chemical Industry Co., Ltd.) was dissolved in 200 g of ion-exchanged water, and the solution was cooled to 5° C. The resulting liquid was designated Composition B.

Composition B was agitated in an emulsifier (Autohomomixer manufactured by Tokushuki Kako K. K.), and Composition A was slowly poured therein to conduct emulsification to prepare an O/W emulsion of oil droplets having a mean particle size of about 12 μm. The emulsion was then stirred in a stirrer equipped with a propeller blade (Three-One Motor manufactured by Shinto Kagaku K. K.) at a speed of 400 rpm. Ten minutes later, 200 g of a 5% triethylenetetramine aqueous solution was added thereto dropwise. After the dropwise addition, the mixture was heated to 60° C. for 3 hours to conduct encapsulation.

After completion of the reaction, the reaction mixture was poured into 2 l of ion-exchanged water, thoroughly stirred, and allowed to stand. After the capsule particles sedimented, the supernatant liquor was removed. The above washing operation with ion-exchanged water was repeated 7 more times. There were thus obtained oily binder-containing capsule particles. Ion-exchanged water was added to the capsule particles to prepare a capsule suspension having a solids content of 40%.

PREPARATION OF TONER

To 125 g of the capsule suspension (containing 50 g of capsule particles) was added 125 g of ion-exchanged water, and the mixture was stirred in Three-One Motor at 200 rpm. To the suspension were added 5 g of 1N nitric acid and 4 g of a 10% cerium sulfate aqueous solution, and 0.5 g of ethylene glycol dimethacrylate was further added thereto, followed by allowing to the mixture to react at 15° C. for 3 hours. After completion of the reaction, the reaction mixture was poured into 1 l of ion-exchanged water, thoroughly stirred, and allowed to stand. After the capsule particles sedimented, the supernatant liquor was removed. This washing operation was repeated two more times to obtain capsule particles having ethylene glycol dimethacrylate grafted to the surface thereof.

The ethylene glycol dimethacrylate-grafted capsule particles were again suspended in ion-exchanged water and stirred in Three-One Motor at 200 rpm. To the suspension were successively added 0.4 g of potassium persulfate, 0.1 g of dimethylaminoethyl methacrylate, and 0.16 g of sodium hydrogensulfite, and the mixture was reacted at 25° C. for 3 hours. After completion of the reaction, the reaction mixture was poured into 2 l of ion-exchanged water, thoroughly stirred, and allowed to stand. After sedimentation of capsule particles, the supernatant liquor was removed. This washing operation was repeated 4 more times.

The resulting capsule suspension was spread on a stainless steel vat and dried in a drier (manufactured by Yamato Kagaku) at 60° C. for 10 hours. A hundred parts of the toner particles were thoroughly mixed with 1 part of hydrophobic silica (RA-200H produced by Nippon Aerosil Co., Ltd.).

Observation of the resulting toner particles under a transmission electron microscope revealed that the magnetic powder was taken in the outer shell but not exposed on the surface of the shell.

EVALUATION OF CAPSULE TONER

Three grams of the resulting capsule toner and 100 g of a phenolic resin-coated iron powder carrier at 20° C. and 50% RH (relative humidity). The quantity of charge of the capsule toner was 13 μC/g, as measured by a blow-off method, which was on a satisfactory level.

As a result of thermogravimetric analysis, the content of diethyl phthalate was confirmed to be equal to the amount charged.

The capsule toner was put to a practical test using a copying machine (FX 2700 manufactured by Fuji Xerox Co., Ltd. modified for using capsule toner) remodeled for a capsule toner. The results were satisfactory in both image quality and fixing properties.

COMPARATIVE EXAMPLE 1

Toner particles were prepared in the same manner as in Example 1, except for replacing 5 g of the aromatic isocyanate (Isonate 143L) and 25 g of the aliphatic isocyanate (Desmodur W) with 30 g of the aliphatic isocyanate (Desmodur W). The particles were mixed with a carrier in the same manner as in Example 1 to obtain a capsule toner.

The resulting capsule toner was evaluated in the same manner as in Example 1. The charge quantity was found to be 3 μC/g, which was much lower than the result of Example 1. The thermogravimetric analysis revealed that the capsule contained no diethyl phthalate. As a result of a practical test, fog developed, many image omissions occurred, and the fixing properties were poor. The observation under a transmission electron microscope showed exposure of the magnetic powder on the surface of the capsule shell.

EXAMPLE 2

PREPARATION OF CAPSULE PARTICLES

In a mixed solvent of 60 g of dibutyl adipate and 60 g of ethyl acetate were dissolved 70 g of a styrene-n-butyl methacrylate copolymer (Mw: $10\times10^4$), and 120 g of magnetic powder (EPT-1000) was added thereto, followed by dispersing in a ball mill for 16 hours.

To 200 g of the dispersion were added 15 g of hexamethylene diisocyanate (Sumidur H produced by Sumitomo Bayer Urethane Co., Ltd.) as an aliphatic isocyanate, 10 g of tolylene diisocyanate (Sumidur T-80 produced by Sumitomo Bayer Urethane Co., Ltd.) as an aromatic isocyanage, and 24 g of ethyl acetate, followed by thoroughly mixing. The resulting liquid was designated Composition A.

Separately, 10 g of hydroxypropylmethyl cellulose (Metholose 60 SH 50) was dissolved in 200 g of ion-exchanged water, and the solution was cooled to 5° C. The resulting liquid was designated Composition B.

Composition B was agitated in an emulsifier (Autohomomixer), and Composition A was slowly poured therein to conduct emulsification to prepare an O/W emulsion of oil droplets having a mean particle size of about 8 μm. The emulsion was then stirred in a stirrer equipped with a propeller blade (Three-One Motor) at a speed of 400 rpm. Ten minutes later, 200 g of a 5% tetraethylenepentamine aqueous solution was added thereto dropwise. After the dropwise addition, the mixture was heated to 60° C. for 3 hours to conduct encapsulation.

After completion of the reaction, the reaction mixture was poured into 2 l of ion-exchanged water, thoroughly stirred, and allowed to stand. After the capsule particles sedimented, the supernatant liquor was removed. The above washing operation with ion-exchanged water was repeated 7 more times. There were thus obtained microcapsules containing an oily binder. Ion-exchanged water was added to the capsule particles to prepare a capsule suspension having a solids content of 40%.

PREPARATION OF TONER

To 125 g of the capsule suspension (containing 50 g of capsule particles) was added 125 g of ion-exchanged water, and the mixture was stirred in Three-One Motor at 200 rpm. To the suspension were added 5 g of 1N nitric acid and 4 g of a 10% cerium sulfate aqueous solution, and 0.5 g of ethylene glycol dimethacrylate was further added thereto, followed by allowing the mixture to react at 15° C. for 3 hours. After completion of the reaction, the reaction mixture was poured into 1 l of ion-exchanged water, thoroughly stirred, and allowed to stand. After the capsule particles sedimented, the supernatant liquor was removed. This washing operation was repeated two more times to obtain capsule particles having ethylene glycol dimethacrylate graft-polymerized to the surface thereof.

The ethylene glycol dimethacrylate-grafted capsule particles were again suspended in ion-exchanged water and stirred in Three-One Motor at 200 rpm. To the suspension were successively added 0.4 g of potassium persulfate, 3 g of sodium allylsulfonate, and 0.16 g of sodium hydrogensulfite, and the mixture was reacted at 25° C. for 3 hours. After completion of the reaction, the reaction mixture was poured into 2 l of ion-exchanged water, thoroughly stirred, and allowed to stand. After sedimentation of capsule particles, the supernatant liquor was removed. This washing operation was repeated 4 more times to obtain capsule toner particles having sodium allylsulfonate graft-copolymerized to the shell surface thereof.

The resulting capsule suspension was spread on a stainless steel vat and dried in a drier of Yamato Kagaku at 60° C. for 10 hours. A hundred parts of the toner particles were thoroughly mixed with 1 part of hydrophobic silica (R972 produced by Nippon Aerosil Co., Ltd.).

EVALUATION OF CAPSULE TONER

Three grams of the resulting capsule toner and 100 g of a phenolic resin-coated iron powder carrier at 20° C. and 50% RH. The quantity of charge of the capsule toner was $-14$ $\mu C/g$ as measured by a blow-off method, which was on a satisfactory level.

As a result of thermogravimetric analysis, the content of dibutyl adipate was confirmed to be equal to the amount charged.

The capsule toner was put to a practical test using a copying machine (FX 2700 modified for using capsule toner). The results were satisfactory in both image quality and fixing properties.

COMPARATIVE EXAMPLE 2

Toner particles were prepared in the same manner as in Example 2, except for replacing the aromatic isocyanate (Sumidur T-80) with 10 g of the aliphatic isocyanate (Desmodur W). The particles were mixed with a carrier in the same manner as in Example 2 to obtain a capsule toner.

The resulting capsule toner was evaluated in the same manner as in Example 2. The charge quantity was found to be $-2$ $\mu C/g$, which was much lower than the result of Example 2. The thermogravimetric analysis revealed that the capsule contained no dibutyl adipate. As a result of a practical copying test, fog developed, many white streaks occurred in the image area, and the fixing properties were poor.

The capsule toner according to the present invention contains colorant particles or magnetic particles in the outer shell thereof without exposing them on the surface of the shell and therefore exhibits satisfactory charging properties, making it possible to provide images with excellent image quality and fixing properties.

While the invention has been described in detail and with reference to specific examples thereof, it will be apparent to one skilled in the art that various changes and modifications can be made therein without departing from the spirit and scope thereof.

What is claimed is:

1. A capsule toner comprising a core material containing a fixing component, an outer shell covering said core material, and a chargeable substance adhered on the surface of said outer shell, said outer shell containing a polyurea resin obtained from at least an aliphatic polyisocyanate and an aromatic polyisocyanate and/or a polyurethane resin obtained from at least an aliphatic polyisocyanate and an aromatic polyisocyanate.

2. A capsule toner as claimed in claim 1, wherein said chargeable substance is chemically bonded to the surface of said outer shell, and said outer shell contains colorant particles and/or magnetic particles.

3. A capsule toner as claimed in claim 2, wherein said colorant particles and/or magnetic particles are not exposed on the surface of said outer shell.

4. A capsule toner as claimed in claim 1, wherein the amount of said aliphatic polyisocyanate is from 2 to 95% by weight based on the total weight of said aliphatic polyisocyanate and said aromatic polyisocyanate.

5. A process for producing a capsule toner comprising a core material containing a fixing component, an outer shell covering said core material, and a chargeable substance adhered on the surface of said shell, said process comprising (a) a step of dispersing at least colorant particles and/or magnetic particles, a fixing component, and an oily component containing an aliphatic polyisocyanate and an aromatic polyisocyanate in a solvent, (b) a step of polymerizing the dispersed particles to form an outer shell containing a polyurea resin and/or a polyurethane resin, and (c) a step of adhering a chargeable substance on the surface of said outer shell.

6. A capsule toner comprising a core material containing a fixing component and an outer shell covering said core material, said outer shell containing a polyurea resin obtained from at least an aliphatic polyisocyanate and an aromatic polyisocyanate and/or a polyurethane resin obtained from at least an aliphatic polyisocyanate and an aromatic polyisocyanate.

7. A capsule toner as claimed in claim 6, wherein the amount of said aliphatic polyisocyanate is from 2 to 95% by weight based on the total weight of said aliphatic polyisocyanate and said aromatic polyisocyanate.

8. A capsule toner as claimed in claim 6, wherein the amount of said aliphatic polyisocyanate is from 5 to 85% by weight based on the total weight of said aliphatic polyisocyanate and said aromatic polyisocyanate.

9. A capsule toner as claimed in claim 6, wherein the amount of said aliphatic polyisocyanate is from 55 to 85% by weight based on the total weight of said aliphatic polyisocyanate and said aromatic polyisocyanate.

10. A capsule toner as claimed in claim 6, wherein the aliphatic polyisocyanate is selected from the group consisting of trimethylene diisocyanate, hexamethylene diisocyanate, 2,2,4-trimethylhexane diisocyanate, cyclohexane-1,2-diisocyanate, 1-methylcyclohexane-2,4-diisocyanate, isophorone diisocyanate, cyclohexylmethane-4,4-diisocyanate, lysine diisocyanate, xylylene diisocyanate, m-phenylenebis (isopropylisocyanate) and dicyclohexylmethane diisocyanate.

11. A capsule toner as claimed in claim 6, wherein said aromatic polyisocyanate is selected from the group consisting of phenylene diisocyanate, tolylene diisocyanate, naphthalene- 1,4-diisocyanate, naphthalene-1,5-diisocyanate, tolidine diisocyanate, diphenylmethane diisocyanate, 3,3'-dimethyldiphenylmethane-4,4'-diisocyanate, 3,3'-dimethoxydiphenylmethane-4,4'-diisocyanate, diphenyl ether-4,4'-diisocyanate, 4,4'-dimethyldiphenylmethane-2,2',5,5'-tetraisocyanate and triphenylmethane-4,4'4''-triisocyanate.

12. A capsule toner as claimed in claim 6, wherein said polyurea resin and/or polyurethane resin is obtained from a combination of aliphatic polyisocyanates.

13. A capsule toner as claimed in claim 6, wherein said polyurea resin and/or polyurethane resin is obtained from a combination of aromatic polyisocyanates.

14. A capsule toner as claimed in claim 6, wherein said core material is (1) a mixture comprising a binder resin, a high-boiling solvent capable of dissolving the binder resin, and a colorant, (2) a mixture comprising a binder resin, an oligomer capable of dissolving the binder resin, and a colorant, or (3) a mixture comprising a soft solid substance and a colorant.

15. A capsule toner as claimed in claim 14, wherein said binder resin is selected from the group consisting of acrylic ester polymers, methacrylic ester polymers, acrylic ester-methacrylic ester copolymers; styrene monomer-(meth) acrylic ester copolymers; ethylenic polymers or copolymers; styrene copolymers, polyvinyl ether, polyvinyl ketone, polyester, polyamide, polyurethane, rubbers, epoxy resins, polyvinyl butyral, rosin, modified rosin, terpene resins and phenolic resins.

16. A capsule toner as claimed in claim 6, comprising a chargeable substance adhered on the surface of said outer shell and comprising a positively chargeable substance comprising a polymerizable monomer having amino, imidazole, pyridiene or piperazine functional group or a negatively chargeable polymerizable monomer having a halogen atom, a nitro, a cyano, a sulfo, a carboxyl, a carboxylic ester or phospho functional group.

17. A capsule toner as claimed in claim 6, wherein said aliphatic polyisocyanate is dicyclohexylmethane diisocyanate and said aromatic polyisocyanate is diphenylmethane diisocyanate.

18. A capsule toner as claimed in claim 6, wherein said aliphatic polyisocyanate is hexamethylamine diisocyanate and said aromatic polyisocyanate is tolylene diisocyante.

19. A capsule toner as claimed in claim 1, wherein said aliphatic polyisocyanate is characterized by a slow reaction rate and said aromatic polyisocyanate is characterized by a fast reaction rate.

20. A capsule toner as claimed in claim 1, wherein said chargeable substance is chemically bonded on the surface of said outer shell.

* * * * *